US005915454A

United States Patent [19]

Wright et al.

[11] Patent Number: 5,915,454

[45] Date of Patent: Jun. 29, 1999

[54] TWIN ROLLER CASTING

[75] Inventors: Leslie Charles Wright, Sheffield, United Kingdom; Dong Kyun Choo, Pohang, Rep. of Korea

[73] Assignee: Davy McKee (Sheffield) Limited, Sheffield, United Kingdom

[21] Appl. No.: 08/860,736

[22] PCT Filed: Jan. 4, 1996

[86] PCT No.: PCT/GB96/00009

§ 371 Date: Jan. 29, 1998

§ 102(e) Date: Jan. 29, 1998

[87] PCT Pub. No.: WO96/20800

PCT Pub. Date: Jul. 11, 1996

[30] Foreign Application Priority Data

Jan. 5, 1995 [GB] United Kingdom ..... 9500156

[51] Int. Cl.[6] ..... B22D 11/06

[52] U.S. Cl. ..... 164/428; 164/480

[58] Field of Search ..... 164/428, 480

[56] References Cited

FOREIGN PATENT DOCUMENTS

| | | | |
|---|---|---|---|
| 60-148646 | 8/1985 | Japan | 164/480 |
| 60-162558 | 8/1985 | Japan | 164/480 |
| 60-166146 | 8/1985 | Japan | 164/480 |

*Primary Examiner*—Kuang Y. Lin

*Attorney, Agent, or Firm*—Fay, Sharpe, Beall, Fagan Minnich & McKee LLP

[57] ABSTRACT

A twin roll casting machine has an end-dam structure at each end of the pair of rolls. Each end-dam structure comprises a first part which is urged into engagement with the rolls in the vicinity of the narrowest part of the gap with a contact pressure which prevents leakage of molten metal. A second part, positioned above the first part, is urged into engagement with the rolls with a contact pressure which is less than that of the first part, but which nevertheless prevents leakage of molten metal.

18 Claims, 1 Drawing Sheet

TWIN ROLLER CASTING

This invention relates to a twin-roll continuous casting machine in which a pool of molten metal is contained between a pair of spaced apart rotatable rolls and a pair of end dams urged against the ends of the rolls and on rotating the rolls, solidified shells of metal formed on the roll surfaces are continuously passed through the narrowest part of the gap between the rolls and are bonded together to form strip.

Each end dam is subjected to forces tending to push the end dam away from the ends of the rolls and external pressure has to be applied to the end dam to prevent this from occurring. The forces applied to the end dam which tend to push the end dam away from the rolls are due to (a) hydrostatic pressure of the molten metal, (b) motion of the molten metal in the pool, and (c) sideways spreading of the metal as it undergoes hot deformation as it passes through the narrowest part of the roll gap.

The force (c) is by far the greatest and most variable of the three forces and so the end dam has to be urged against the ends of the rolls with a force which is greater than this force (c) so that leakage does not occur. It will be appreciated that there is wear between the stationary end dam and the ends of the rotating rolls and the greater the contact pressure between the end dam and the rolls, the greater the wear.

Furthermore, the upper part of the end dam which helps to locate the molten pool should not encourage solidification of the molten metal whereas the lower part of the end dam does not necessarily have to promote solidification although it may be beneficial.

An object of the present invention is to provide a twin-roll continuous casting machine having improved end-dams.

It is known from JP-A-60 148646 for a twin roll continuous casting machine to have a pair of end dam structures disposed at and urged into engagement with the axial ends of a pair of rotatable rolls. Each end dam structure comprises three parts arranged in a stack. The uppermost dam part presses against the ends of the rolls with a constant pressure and each of the lower two parts are urged against the ends of the rolls such that if the pressure applied to these parts by the solidified casting exceeds a predetermined value, the parts move away from the ends of the rolls and return into engagement with the ends of the rolls when the pressure is reduced below the predetermined value.

According to the present invention a twin-roll continuous casting machine comprises a pair of rotatable rolls arranged in side-by-side parallel relation with a gap therebetween and a pair of end dam structures disposed at and urged into engagement with the axial ends of the roll barrels so that in use, a pool of molten metal is contained between the rolls and the end dam structures and solidified shells of metal pass continuously through the narrowest part of the gap between the rolls and are bonded together to form strip; characterised in that each end dam structure comprises a first part located adjacent the narrowest part of the gap and a second part above the first part, said first part being mounted on a support arm which has means for urging the support arm towards the ends of the roll barrels to force the first part into engagement with the ends of the roll barrels and pressure exerting means mounted on the support arm which serve to urge the second part into engagement with the ends of the roll barrels, said first part being urged into engagement with the rolls with a contact pressure which may be different than that between the second part and the rolls.

The part of each end dam which abuts the rolls adjacent the narrowest part of the gap is subjected to force (c) referred to above and the pressure applied by the support arm to this part of the end dam is sufficiently large to maintain sealing with the ends of the rolls.

The other part of the end-dam is usually subjected to a lower contact pressure with the ends of the rolls because the pressure exerted by the molten metal on this part of the end dam is lower.

By splitting the loadings on the end dam, if the load on the lower part is exceeded, the seal between the upper part of the end dam is likely to be maintained due to the independent loading. The possibility of recovering the situation and having the seal restored between the lower part of the end dam and the rolls is increased when there is different loadings on the two parts of the end dam. If the two parts of the end dam are of different materials it is likely that there will be a difference in wear of the materials. Having each part loaded independently compensates for the differential wear thus maintaining the seal.

BRIEF DESCRIPTION OF THE DRAWINGS

In order that the invention may be more readily understood it will now be described, by way of example only, with reference to the accompanying drawings in which.

Figure 1:
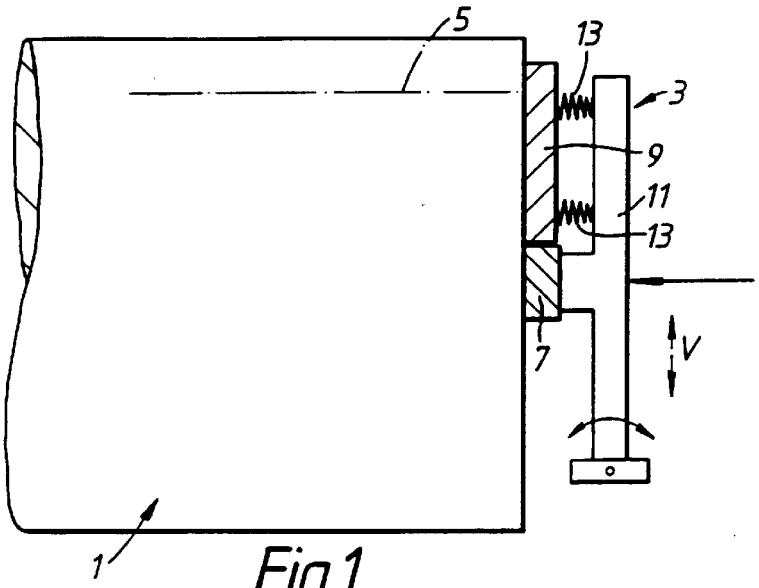
FIG. 1 is a diagrammatic side view of one end of a twin roll caster.

A twin-roll continuous caster comprises a pair of rotatable rolls, one of which is indicated in FIG. 1 by reference numeral 1, arranged with their axes of rotation substantially horizontal and positioned in side-by-side relation with a gap between the rolls. Each roll has a stub shaft at each end of its roll barrel and the rolls are rotatably mounted with the stub shafts in support housings (not shown) and means (also not shown) are employed to rotate the rolls. At each end of the pair of rolls an end dam structure 3 is provided which bears against the ends of the roll barrels with sufficient contact pressure to enable a pool of molten metal to be contained between the rolls and the end dams without significant leakage between them. The surface of the molten pool is indicated by reference numeral 5 in FIG. 1. In use, the rolls are cooled and are rotated so that the roll surfaces in the gap between the rolls are moving downwardly. Shells of solidified metal are formed on each roll where the pool contacts the cooled roll surface and as the rolls are rotated the shells come together at the narrowest part of the gap between the rolls and are bonded together by the pressure exerted by the rolls to form a metal strip.

As shown in FIG. 1, the end dam structure 3 comprises a first part 7 which is adjacent the narrowest part of the roll gap and a separate independently movable second part 9 above the first part. A support arm 11 is pivoted at its lower end and the part 7 is secured to the support arm. Means not shown, but which usually comprises one or more fluid operated rams, exerts a pressure P on the support arm to pivot the arm and force the part 7 of the end dam against the ends of the roll barrels with sufficient force to prevent leakage between the part 7 of the end dam and the ends of the rolls. This force has to overcome at least the force which is exerted on the end dam by the solidified metal as it passes through the narrowest part of the roll gap. The part 9 of the end dam also has to be urged against the ends of the roll barrels to prevent leakage but usually a lower pressure is required than that required by part 7 and so a plurality of pressure exerting means 13 are mounted on the support arm 11 and act between the support arm and the part 9 of the end dam. The pressure exerted on the part 9 by the means 13 is such as to result in a contact pressure which prevents leakage between the part 9 and the ends of the roll barrels but it is usually less than the contact pressure between the part 7 and the rolls barrels.

The part 7 is of a material which has low wear properties because the high contact pressure between the part and the ends of the roll barrels could lead to rapid wear of the material. It may be a refractory material, and therefore can have suitable thermal insulating properties, or a metal such as copper which is cooled.

The part 9 is subjected to a lower contact pressure with the ends of the roll barrels and so it is not so prone to wear and can have higher wear properties than the material of part 7. The part 9 should not encourage solidification of the molten metal in the pool on this part of the end dam.

Figure 2:
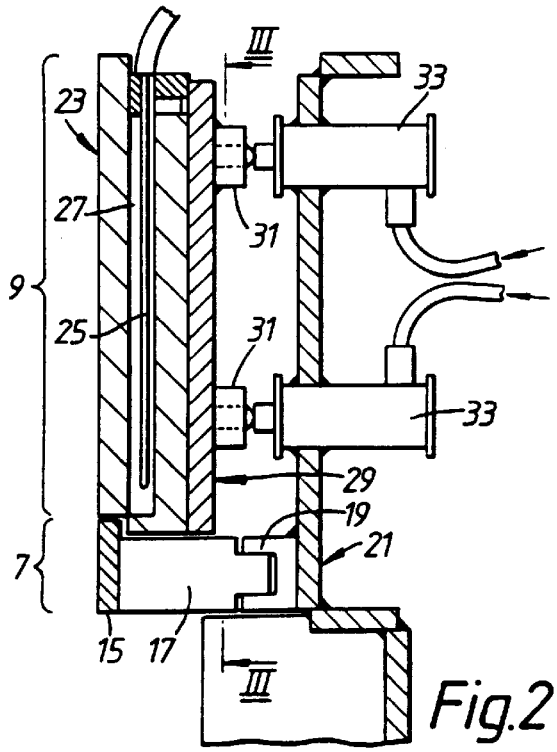
FIG. 2 is a sectional side view of an end dam structure in accordance with the present invention and FIG. 3 is an end view of the structure shown on section line III—III of FIG. 2.
Figure 3:
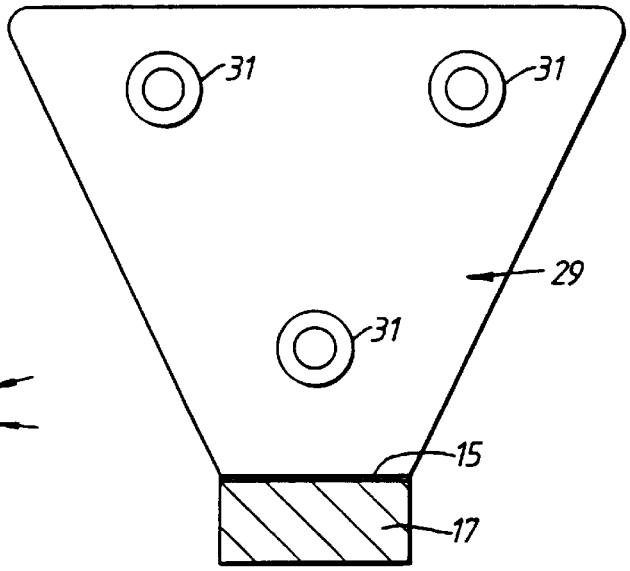

Referring now to FIGS. 2 and 3, the first part 7 of the end dam structure comprises a body of refractory material 15, such as sialon or boron nitride based material, mounted on a cooled metal plate 17. The plate is pivotally mounted on a bracket 19 projecting from a support arm 21. The second part 9 of the end dam comprises a refractory plate 23 such as fused silica which is mounted in face-to-face relation with the front face of a metal plate 29. Preheating is used to heat the refractory plate 23 prior to introducing molten metal into contact therewith to discourage metal in the pool from solidifying in contact with the plate. This may be brought about by electrical heaters 25 located in slots 27 in the refractory plate 23. On the back of the metal plate 29 there are three self aligning couplings 31 to which fluid operable rams 33 are connected. These rams are mounted on the support plate 21 and so the pressure between the support plate and the second part of the end dam can be adjusted.

The support plate is pivoted at its lower end and is urged towards the ends of the roll barrels by one or more rams (not shown) to cause the body 15 to engage the ends of the roll barrels with a sufficiently high contact pressure to prevent leakage of molten metal. The provision of the rams 33 permit the upper plate 23 to be urged against the ends of the roll barrels with a lower contact pressure than the contact pressure between the body 15 and the rolls but still prevent leakage of molten metal.

The rams 33 shown in FIG. 2 are conveniently pneumatic cylinders with a spring return but any form of pressure exerting means may be employed. Any convenient number of pressure exerting means may be employed.

Each end-dam structure may be vibrated in the direction parallel to the depth of the gap between the rolls, i.e. when the roll axes are parallel and in a horizontal plane, the end dams are vibrated vertically.

We claim:

1. A twin-roll continuous casting machine comprising:

a pair of parallel, side-by-side rotatable roll barrels (1) with a gap therebetween;

a pair of end dam structures (3) disposed at and urged into engagement with axial ends of the roll barrels, wherein a pool (5) of molten metal is contained between the roll barrels and the end dam structures, wherein solidified shells of metal pass continuously through the narrowest part of the gap between the roll barrels and wherein the solidified shells of metal are bonded together to form a strip;

wherein each end dam structure comprises:

a first part (7, 15) located adjacent the narrowest part of the gap, a second part (9, 23) located above the first part, a support arm (11, 21) wherein said first part is mounted on said support arm and said second part is coupled to said support arm, and a single means for urging the support arm towards the ends of the roll barrels to force the first part (7, 15) into engagement with the ends of the roll barrels; and at least one pressure exerting means (13, 33) mounted on the support arm which urges the second part (9, 23) into engagement with the ends of the roll barrels, wherein the first part (7, 15) and the second part (9, 23) are urged by the support arm at differing pressures.

2. A twin-roll continuous casting machine as claimed in claim 1 in which the pressure exerting means is so arranged that the first part (7, 15) is urged into engagement with the roll barrels with a higher contact pressure than that between the second part and the roll barrels.

3. A twin-roll continuous casting machine as claimed in claim 1 in which the first part (15) has lower wear properties than the second part (23).

4. A twin-roll continuous casting machine as claimed in claim 1 in which the first (15) and second (23) parts are made of different refractory materials.

5. A twin-roll continuous casting machine as claimed in claim 1 in which the second part (23) has thermal insulating properties in order to retard solidification.

6. A twin-roll continuous casting machine as claimed in claim 1 in which the second part (23) has provision (25) for heating that part which is to be adjacent the molten metal prior to introducing molten metal into contact with the part.

7. A twin-roll continuous casting machine as claimed in claim 1 in which the first part (15) has provision for cooling the part to promote solidification of the material in the gap.

8. A twin-roll continuous casting machine as claimed in claim 1 in which the pressure exerting means (33) comprise one or more fluid-operable means.

9. A twin-roll continuous casting machine as claimed in claim 1 in which means are provided for vibrating each end-dam structure in the direction parallel to the depth of the gap between the rolls.

10. A twin-roll continuous casting machine comprising:

a pair of spaced rotatable rolls arranged in a side by side parallel relation and having a gap therebetween;

a pair of end dam structures disposed at and urged into engagement with respective axial ends of said pair of rotatable rolls wherein, in use, a pool of molten metal is contained between said pair of rotatable rolls and the end dam structures and wherein solidified shells of metal pass continuously through a narrowest part of the gap between the rolls, the solidified shells of metal being bonded together to form a strip;

each said end dam structure comprising:

a support arm, said support arm being pivotably mounted on an adjacent support surface, a first part rigidly mounted to said support arm, a second part located above said first part, said second part being resiliently mounted to said support arm; and a means for exerting pressure on said support arm for urging the support arm towards the end faces of the pair of rotatable rolls, wherein said first part is urged into engagement with the rolls with a contact pressure which is greater than a contact pressure of said second part against the rolls.

11. The twin roll continuous casting machine of claim 10 wherein said first part is made of a material which has lower wear properties than a material from which said second part is made.

12. The twin roll continuous casting machine of claim 11 in which said first and second parts are made of different refractory materials.

13. The twin roll continuous casting machine of claim 10 in which said second part is made of a material that has thermal insulating properties in order to retard solidification.

14. The twin roll continuous casting machine of claim 10 further comprising a means for heating said second part prior to introducing molten metal into contact with the part.

15. The twin roll continuous casting machine of claim 10 further comprising a means for cooling said first part to promote solidification of the material in the gap.

16. The twin roll continuous casting machine of claim 10 further comprising at least one fluid operable pressure exerting means contacting said second part for urging said second part toward said end faces of said pair of rotatable rolls.

17. The twin roll continuous casting machine of claim 10 further comprising at least one spring, mounted between said support arm and said second part, for urging said second part toward said end faces of said pair of rotatable rolls.

18. The twin roll continuous casting machine of claim 10 further comprising a means for vibrating each end dam structure in a direction parallel to a depth of the gap between said pair of rolls.

* * * * *